US005709152A

United States Patent [19]

Ohara et al.

[11] Patent Number: 5,709,152

[45] Date of Patent: Jan. 20, 1998

[54] END JOINING DEVICE FOR CARRIER TRAVELING RAILS

[75] Inventors: Yasunari Ohara, Kakogawa; Shigehiko Harada, Daito, both of Japan

[73] Assignee: Tsubakimoto Chain Co., Osaka, Japan

[21] Appl. No.: 601,436

[22] Filed: Feb. 14, 1996

[30] Foreign Application Priority Data

Feb. 15, 1995 [JP] Japan ..... 7-049317

[51] Int. Cl.[6] ..... E01B 11/00

[52] U.S. Cl. ..... 104/89; 104/93; 104/106; 104/111; 238/166; 238/172; 238/174

[58] Field of Search ..... 104/111, 93, 91, 104/89, 94, 95, 106, 123, 118; 238/10 R, 151, 166, 174, 249, 259, 172

[56] References Cited

FOREIGN PATENT DOCUMENTS 5-42302 6/1993 Japan .

*Primary Examiner*—Mark T. Le

*Attorney, Agent, or Firm*—Armstrong, Westerman Hattori, McLeland & Naughton

[57] ABSTRACT

A device for joining two spaced confronting fixed ends of two adjacent rails which are misregistered in a vertical, a horizontal or a longitudinal direction without forming a step therebetween. In one form the joint device includes a universal joint rail 1C disposed between two spaced fixed ends 2A, 2B and joined with them via universal joints 5. In another form, the joint device includes an expansion joint rail 3A disposed longitudinally between the fixed ends via a longitudinally movable connecting bar 8 and a resilient member 10.

1 Claim, 4 Drawing Sheets

END JOINING DEVICE FOR CARRIER TRAVELING RAILS

FIELD OF THE INVENTION

The present invention relates to a device for jointing two rails at their fixed ends confronting together with a space therebetween.

DESCRIPTION OF THE RELATED ART

In the conveyance of goods or articles between two adjacent buildings, it is desirable that a carrier traveling rail in one building and a carrier traveling rail in the other building are joined together end to end to form a single traveling rail extending continuously between the two buildings, and the articles are conveyed along the thus formed single continuous traveling rail. However, since fixed ends to be joined together of adjacent carrier traveling rails of the two buildings are generally out of alignment or registration with each other due to dislocations of the carrier traveling rails of the building, a distortion of either building itself, or a longitudinal thermal elongation or contraction of the carrier traveling rails, attempted joining of these misregistered two ends would encounter a great difficulty. With this difficulty in view, Japanese Patent Laid-open Publication No. 5-420302, for example, discloses a parallel movable connecting rail disposed between the joined fixed rail ends so as to correct a misregistration therebetween.

According to the prior art mentioned above, a carrier is transferred onto the parallel movable connecting rail, then while the carrier is temporarily stopped on the parallel movable connecting rail, the connecting rail is parallel displaced to correct the misregistration, and thereafter the carrier is transferred to the outside of the connecting rail. Since a temporary stop of the carrier on the connecting rail is unavoidable, the prior art has a problem that continuous traveling of the carrier from one building to the other is difficult to achieve.

SUMMARY OF THE INVENTION

The present invention seeks to provide a solution to the foregoing problem of the prior art either by way of a universal joint rail disposed between two spaced confronting fixed ends of two adjacent carrier traveling rails which are out of registration in a vertical plane wherein each end of said universal joint rail and a corresponding one of the two fixed ends of the carrier traveling rails are joined together by a universal joint, or by way of an expansion joint rail disposed between two confronting fixed ends of two adjacent carrier traveling rails which are spaced from each other in the longitudinal direction, a pair of brackets provided, respectively, on a side surface of an end of said expansion joint rail and on a side surface of a corresponding one of the two fixed ends of the carrier traveling rails; a resilient member sandwiched between said brackets; and a connecting bar loosely fitted through said resilient member and longitudinally movably supported on said brackets.

The universal joint rail jointed via a universal joint with the fixed end of each carrier traveling rail is permitted to swing in any direction to meet a misalignment or misregistration existing in vertical and horizontal planes between two spaced confronting fixed ends of the two adjacent carrier traveling rails. The misregistered fixed ends can therefore be joined together with the misregistration absorbed by the universal joint. On the other hand, in the case of the expansion joint rail including a connecting bar loosely fitted through a resilient member held in sandwiched condition, when the longitudinally spaced confronting fixed ends of the carrier traveling rails joined by the expansion joint rail are longitudinally displaced due to thermal expansion and contraction of the carrier traveling rails, such a longitudinal displacement of the fixed ends can be taken out or absorbed by expansion or contraction of the resilient member caused by longitudinal movement of the connecting bar.

The embodiment shown in these drawing figures relate to ceiling suspension rails. It is to be noted however that the present invention can be also applied to a joining device for joining rails laid on a floor.

DESCRIPTION OF THE PREFERRED EMBODIMENT

Figure 1:
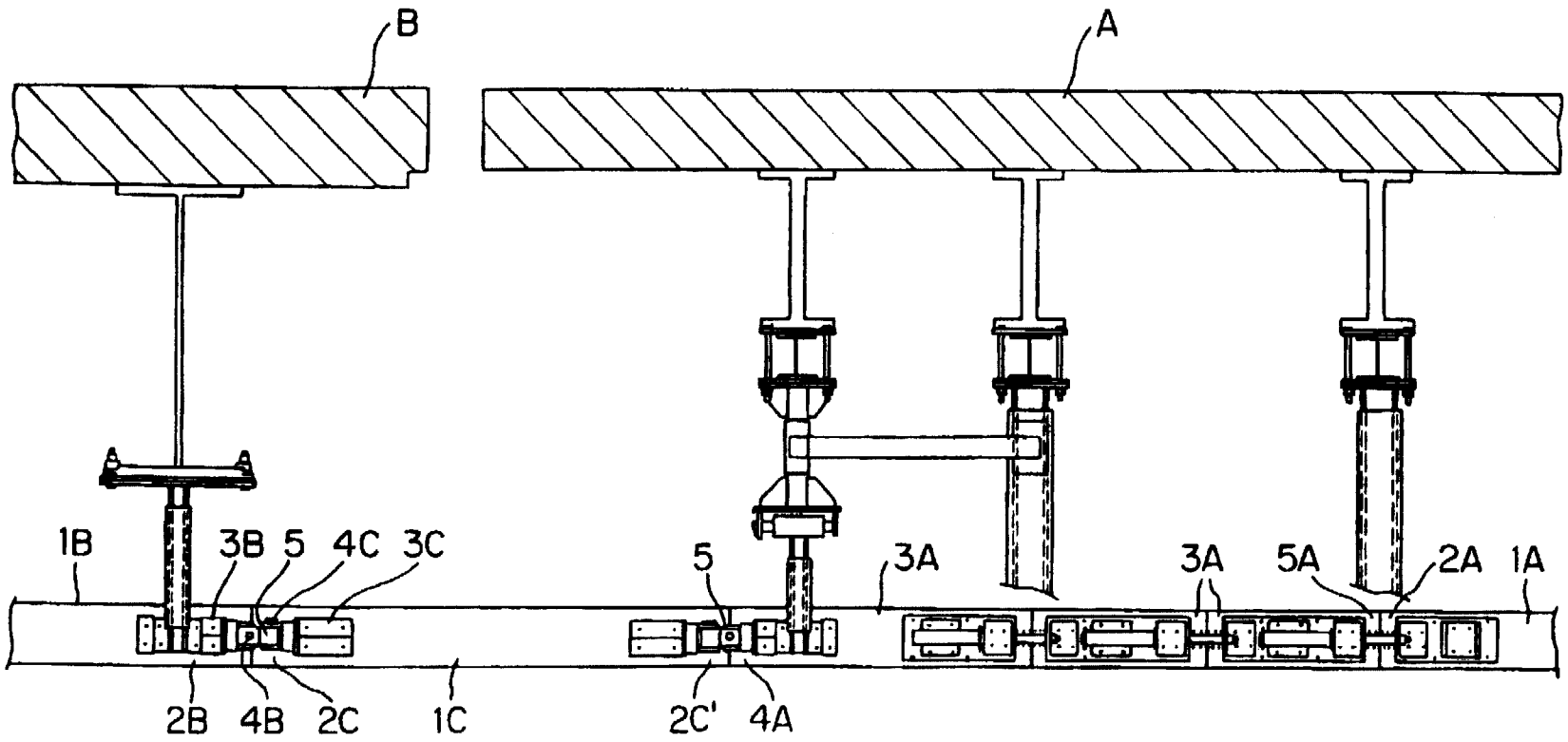
FIG. 1 is a front elevational view of a joining device for joining ceiling suspension rails of two adjacent buildings according to an embodiment of the present invention.

Referring now to FIG. 1, there are shown two carrier traveling rails 1A and 1B suspended from the respective ceilings of two adjacent or neighboring buildings A and B, with their joined fixed ends 2A, 2B held in lot longitudinally spaced confronting relation to each other. A universal joint rail 1C and a plurality of segmented or discrete expansion joint rails 3A are disposed in series between, and joined with, the joined fixed ends 2A, 2B.

Figure 2:
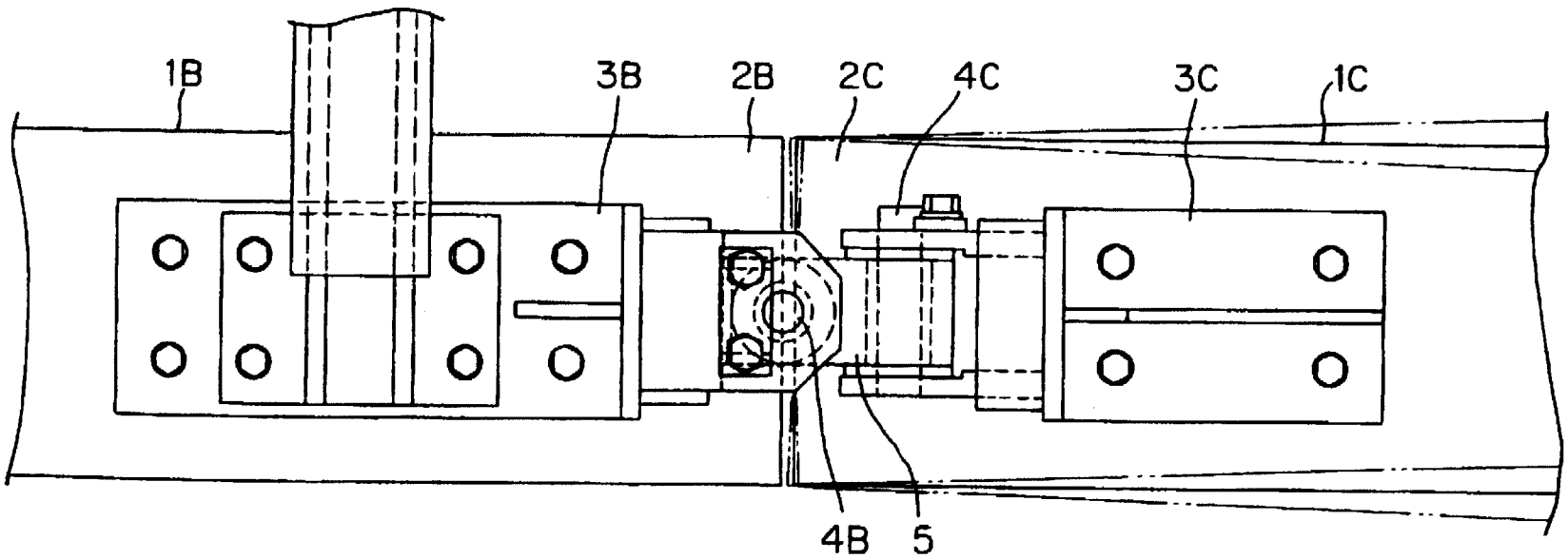
FIG. 2 is an enlarged front elevational view of a main portion of the joining device of FIG. 1 including a universal joint rail.

FIG. 2 is an enlarged front elevational view showing a joint portion between the joined fixed end 2B of the carrier traveling rail 1B of the building B and an end 2C of the universal joint rail 1C. The fixed end 2B and the end 2C of the universal joint rail have, on their one side surface, brackets 3B and 3C. One of the brackets 3B, 3C is provided with a horizontal pin 4B and the other bracket is provided with a vertical pin 4C. The horizontal and vertical pins 4B, 4C are coupled together by a universal joint 5 which permits the pins 4B, 4C to turn or rotate about their own axes.

The universal joint rail 1C is, therefore, permitted to swing vertically about the horizontal pin 4B, as indicated by the two-dot chain lines, and also swing horizontally about the vertical pin 4C. Similarly, the opposite end 2C' of the universal joint rail 1C shown in FIG. 1 and a joined end 4A of an adjacent one of the expansion joint rails 3A are jointed together by a universal joint 5.

In the case where the opposite end 2C' of the universal joint rail 1C and the joined fixed end 2A of the carrier traveling rail 1A are in contact with each other, they can be directly joined together. In such a case, the expansion joint rail 3A is not needed any more.

Figure 3:
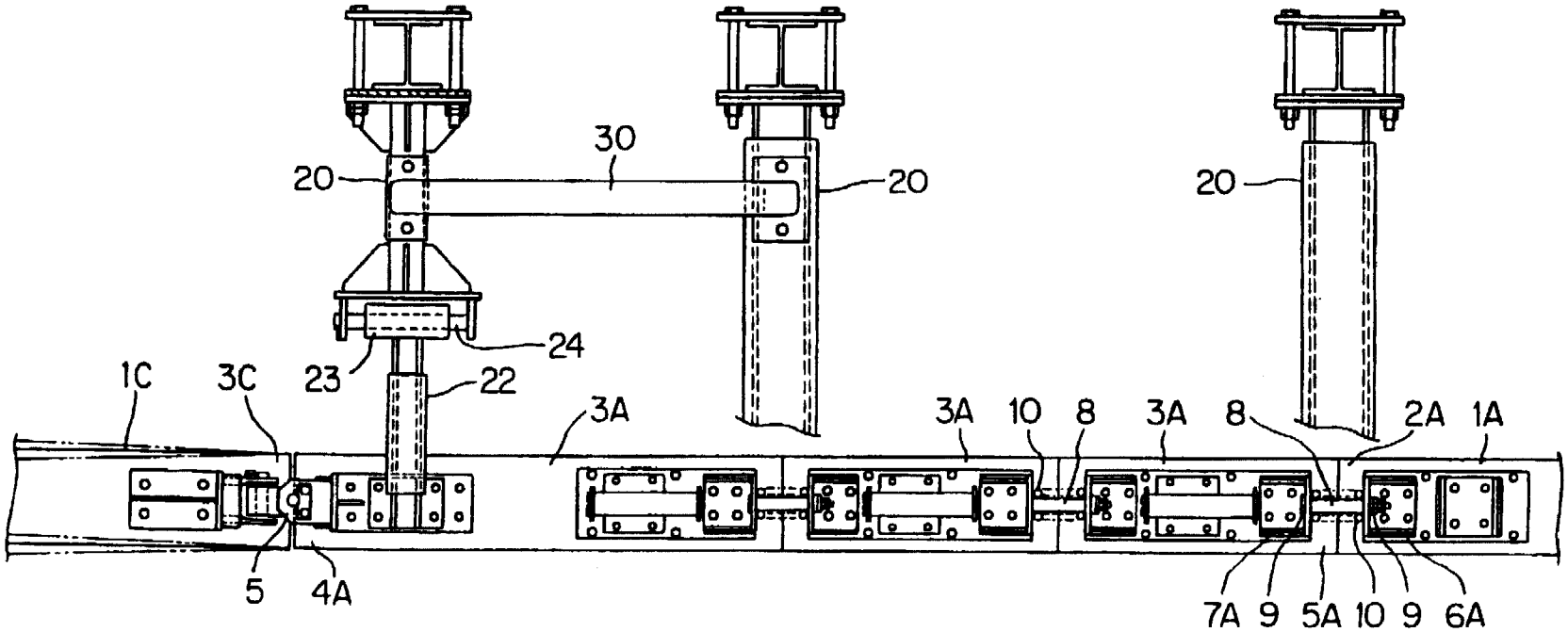
FIG. 3 is an enlarged front elevational view of a main portion of the joining device of FIG. 1 including an expansion joint rail.

FIG. 3 is an enlarged front elevational view showing a joint portion of the expansion joint rail 3A. A joined fixed end 2A of the carrier traveling rail 1A and a joined end 5A of an adjacent one of the expansion joint rails 3A carry, on their one side, a pair of brackets 6A, 7A, respectively. A connecting rod or bar 8 is supported on and between the brackets 6A and 7A in such a manner that the connecting bar 8 is freely movable in a longitudinal direction. In order to prevent the brackets 6A, 7A from separating from each other beyond a limit, the connecting bar 8 is provided with stoppers 9, 9 (in the form of a bolt and a nut in the illustrated embodiment) located on an outer side of the respective brackets 6A, 7A. A resilient member 10, such as a coil spring or a rubber block, is loosely fitted around the connecting bar 8 and is sandwiched between confronting surfaces of the brackets 6A, 7A.

Similarly, each pair of adjacent expansion joint rails 3A is joined together by a connecting bar 8 and a resilient member 10 fitted around the connecting bar 8. The joined ends of the expansion joint rails 3A are composed of beveled surfaces 11 overlapping with each other to ensure that the carrier can smoothly and silently pass through a joint between the expansion joint rails 3A without generating vibrations. The confronting beveled surfaces 11, 11 of the joint are spaced from each other by a clearance or gaps for taking out or absorbing an elongation of each rail 3A.

Figure 4:
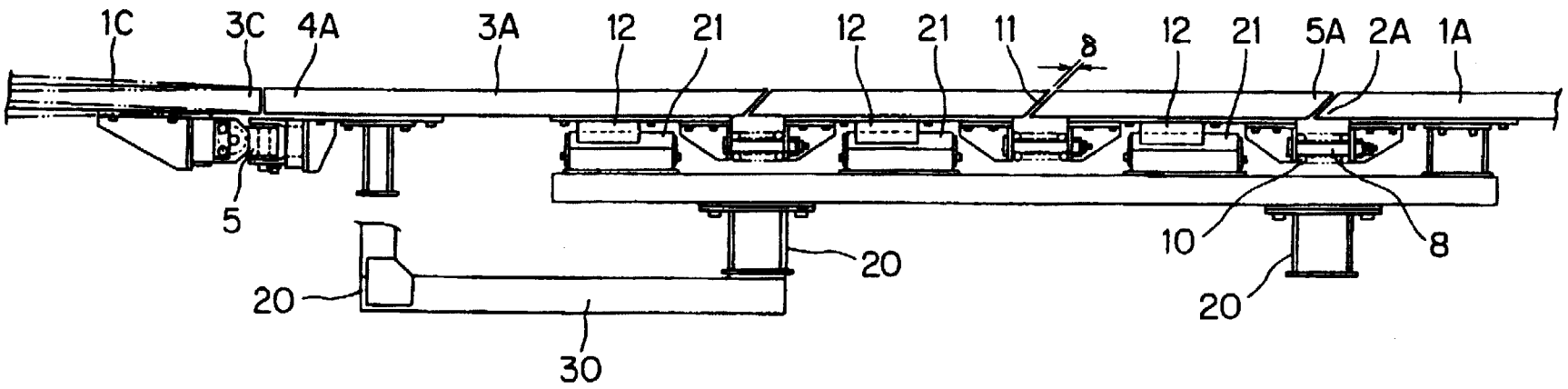
FIG. 4 is a plan view of FIG. 3.

As clearly shown in FIG. 4, each of the expansion joint rails 3A has, on its side surface, a longitudinally extending slide plate 12. The slide plate 12 is slidably guided by a longitudinal slide guide plate 21 supported by a suspension rod 20 depending from the ceiling so that a longitudinal displacement of the expansion joint rail 3A caused due to its elongation or contraction is guided. A free end composed of the joined end 4A of an endmost expansion joint 3A has a longitudinal guide bar 24 loosely fitted through a slide member 23 formed at an upper end of a suspension rod 22 provided on the joined end 4A. The joined end 4A of the expansion joint rail 3A is thus suspended while being guided for its longitudinal displacement caused due to elongation and contraction of this expansion joint rail 3A.

EFFECTS OF THE INVENTION

According to the present invention, two longitudinally spaced confronting fixed ends of two adjacent carrier traveling rails are joined by a universal joint rail with a universal joint disposed between each end of the universal joint rail and a corresponding one of the two fixed ends of the carrier traveling rails. Accordingly, even when the fixed ends are misaligned or misregistered, such a misregistration can be taken out or absorbed by the universal joint which permits relative movement of two joined ends in vertical and horizontal directions. Furthermore, when a space between the two confronting fixed ends is changed due to longitudinal elongation and contraction of the carrier traveling rails, such a change in the spacing between the fixed ends can be taken out or absorbed by a combination of a longitudinally movably supported connecting bar and a resilient member fitted around the connecting bar. Thus, even when the carrier traveling rail in one building and the carrier traveling rail in the other building are laying with their confronting fixed ends misaligned or misregistered with each other, the misregistered fixed ends can be joined together without forming a noticeable step and hence insure continuous passage therethrough of the carrier.

We claim:

1. An end joining device for fixed carrier traveling rails for joining the ends of such traveling rails to each other and forming a continuous traveling rail, comprising: an expansion joint rail disposed between two confronting fixed ends of two adjacent carrier traveling rails to be joined and which are spaced from each other in the longitudinal direction, said expansion joint rail having a pair of brackets provided, respectively, on a side surface of an end of said expansion joint rail and on a side surface of a corresponding one of the two fixed ends of the carrier traveling rails; a resilient member sandwiched between said brackets; and a connecting bar loosely fitted through said resilient member and longitudinally movably supported on said brackets for joining said end of said universal joint rail and said corresponding end of said carrier travel rail and absorbing horizontal and vertical misalignments between said end of said universal joint rail and said end of said carrier travel rail.

* * * * *